United States Patent [19]

Troncoso, Jr.

[11] 4,050,696

[45] Sept. 27, 1977

[54] ARCHERY ARROW

[76] Inventor: Fernando Troncoso, Jr., 1851 S. Orange Ave., Monterey Park, Calif. 91754

[21] Appl. No.: 715,188

[22] Filed: Aug. 17, 1976

[51] Int. Cl.[2] ..... F41B 5/02

[52] U.S. Cl. ..... 273/106.5 B; 273/106.5 R

[58] Field of Search ..... 273/106.5, 171, 169; 46/28, 29

[56] References Cited

U.S. PATENT DOCUMENTS

| | | | |
|---|---|---|---|
| 922,444 | 5/1909 | Youds | 273/169 |
| 1,789,575 | 1/1931 | Allen | 273/106.5 B |
| 1,920,021 | 7/1933 | Schroeder | 46/29 X |
| 2,042,007 | 5/1936 | Kennedy | 46/29 |
| 2,816,765 | 12/1957 | Stockfleth | 273/106.5 B |
| 3,116,926 | 1/1964 | Owen et al. | 273/171 X |
| 3,652,094 | 3/1972 | Glover | 273/171 |

FOREIGN PATENT DOCUMENTS

| | | | |
|---|---|---|---|
| 527,485 | 7/1921 | France | 273/171 |
| 589,629 | 6/1947 | United Kingdom | 293/106.5 R |
| 508,709 | 7/1939 | United Kingdom | 273/106.5 R |
| 347,502 | 4/1931 | United Kingdom | 273/171 |

OTHER PUBLICATIONS

Archery Magazine Oct. 1975 p. 7.

*Primary Examiner*—Paul E. Shapiro
*Attorney, Agent, or Firm*—Donald E. Nist

[57] ABSTRACT

An improved archery arrow is provided which includes an arrow shaft with vanes adjacent its rear end, and a novel arrow pile at its front end. The pile has removable ball bearings, or a threaded weight plug, and/or a scored attaching portion which is readily breakable for shortening and lightening the pile, for controlling the weight and weight distribution of the pile in order to regulate the spine and balance of the arrow for improved performance. The pile point is of improved aerodynamically tapered, dome-shaped configuration for higher, longer flight. Alternatively the pile may have a threaded shaft extending rearwardly therefrom with a split sleeve and wedge threaded thereon. The position of the sleeve and wedge along the length of the shaft adjusts the weight distribution and expansion of the sleeve caused by insertion of the wedge therein provides a mechanism for readily adjusting the pile to fit variations in the internal diameter of the arrow shaft so as to ensure a snug fit between it and the arrow shaft, yet permit ease of installation of the pile in the shaft. The improved arrow is simple, inexpensive and durable and it exhibits improved flight performance, while permitting easy tuning of the arrow to the individual requirements of the archer and his bow.

8 Claims, 6 Drawing Figures

ARCHERY ARROW

BACKGROUND OF THE INVENTION

1. Field of the Invention

The present invention generally relates to sports devices and more particularly to improved archery arrows having improved piles.

2. Prior Art

Conventional archery arrows include elongated usually hollow shafts fitted at their rear ends with string nocks and at their front ends with arrow piles. Such arrow piles usually include an elongated hollow tube releasably affixed to the front end of the arrow shaft and a point connected to the front end of the pile tube. The size and shape of the points vary, depending on the type of arrow and the use to which it is to be put. Thus, for hunting purposes, broadheads may be used. For field archery, field or target points are suitable. For target archery target points are used. Whatever the shape of the points, they usually end in a sharp tip, although even this is not the case for so-called blunts. Most commonly used are the target points which have outer surfaces which are cone-shaped. Thus, in outline, the edges of the point run in straight lines from the apex or tip to the base or rear end of the point. Such points cause the air being passed through during arrow flight to tend to flow outwardly away from the arrow shaft. This is also the case with field points, which are curved inwardly over part of their length and with most other arrows.

A variety of shapes have been utilized for arrow vanes and points and various combinations of shaft diameters, lengths and thicknesses, all with a view toward improving arrow flight, speed and accuracy. Further improvements are desired. For example, it is known that arrow speed has an influence on accuracy of shooting. Thus, a higher arrow speed means a flatter trajectory which in turn means a greater effective target area, resulting in higher scores. Higher arrow speed can be achieved by increasing the draw weight of the archery bow, but when this is excessively increased the increased muscular effort to shoot the bow reduces accuracy in a long tournament. Arrow speed is also dependent on the particular construction of the bow. Accordingly, selection of a "faster" bow at a given draw weight can increase arrow speed. Moreover, the weight of the arrow itself can, within limits, be selected for speed. However, the size of the vanes used on the arrow to stabilize it in flight cannot be reduced excessively without adversely affecting the flight performance of the arrow. Means have been sought to further increase arrow speed without interfering with its stability in flight and thus its ability to fly accurately shot after shot.

In order for an arrow to fly properly, with a maximum of speed and accuracy, it must be properly spined relative to the draw weight of the bow and the actual propulsion force placed on it by the bow string during release of the arrow. By spine is meant the degree of flexibility of the arrow shaft. This in turn depends on the wall thickness and diameter of the arrow shaft, its length and the materials from which the shaft is made. The shaft should bend enough to clear the bow without striking it during shooting of the arrow, but not enough to cause the arrow to fly inaccurately. Arrow shafts are manufactured with various spines to suit individual needs.

In fine tuning a bow for maximum shooting efficiency it is sometimes necessary to change the spine of the arrow. It is impractical to vary the shaft length, as by shortening it, to change the arrow spine. However, arrow spine can also be changed by increasing the weight of the arrow pile to weaken the arrow spine or by decreasing that weight to strengthen the arrow spine. It is conventional to change arrow piles, that is, substitute standard length piles or long heavy piles, as needed. This is expensive, requiring a new set of piles for the arrows. Therefore, it would be desirable to provide improved means for accomplishing the desired effect.

Consideration should also be given to means for providing proper weight distribution at the arrow pile. Such weight distribution affects balance and therefore arrow flight. Conventional target piles come in only a few standard lengths per arrow size and offer no adjustability. An arrow pile readily adjustable in weight distribution as well as weight would permit improved ease of fine tuning.

In originally inserting and/or changing arrow piles in arrows, considerable difficulty is often encountered because of normal variations in the internal diameter of the arrow shaft. Although a close fit is desired between the pile and shaft so as to prevent loosening and loss of the pile when removing the arrow from dense targets, too close a fit makes insertion in and removal of the pile tube from the shaft difficult. It would be desirable to be able to provide means for adjusting the pile to properly fit the arrow shaft.

SUMMARY OF THE INVENTION

The foregoing needs have been satisfied by the improved archery arrow of the present invention. The arrow is substantially as set forth in the Abstract above. Thus, the arrow has an improved pile which includes a point having an aerodynamically shaped dome-shaped outer surface between its tip and its rear end. Its rear end is smooth and grooveless as is the rest of its outer surface. Accordingly, air is made to flow close to the arrow shaft during arrow flight and more directly into contact with the arrow vanes, so that the vanes can be made smaller and still adequately stabilize the arrow. Smaller vanes weigh less so the arrow is lighter and can fly faster. The smooth point surfaces also assure that a draw check blade can pass over the point without catching in it and thus triggering premature release of the arrow by the archer. When an archer uses a clicker or other draw check, he depends on feel as well as sound to tell him when the arrow has been pulled back far enough to allow the blade to strike the side of the bow and alert the archer to release the arrow. The blade may strike the side of the bow inaudibly but provide a slight vibration. The same sensation can occur when the blade hangs up in a surface groove in a conventional arrow point. If the arrow is shot prematurely, that is, while still under the clicker or draw check blade, not only will the draw force, that is the force imparted by the bowstring to the arrow, be less than otherwise, but the clicker blade will drag on the arrow shaft and vanes and may impair the latter, so that slower and less accurate arrow flight results. The present arrow and pile eliminate a cause of premature shooting i.e. shooting through a clicker.

The improved pile also has a tube which has means for controlling the weight and weight distribution of the pile. Thus, the pile tube may be scored and thus can be shortened by breaking off scored portions to easily change the pile balance and weight for fine tuning of the arrow-bow combination. Moreover, the point can be made solid or hollow and, in the latter case, can be adjusted in weight, as by filling it to a desired extent with material, such as lead, which can be readily removed, as by drilling or the like, to adjust the point weight. The pile tube can also receive a weight plug which preferably is a set screw threadably received therein. The plug or set screw can hold removable weights, such as ball bearings, within the tube at the desired location.

Finally, the pile tube can include one or more slits therethrough which allow it to be reduced in diameter, as needed, during its insertion in the arrow shaft. The pile tube can also include an expansion portion to increase the tube diameter, as needed, all to ensure a close fit with the arrow shaft and facilitate insertion and removal of the pile. Further features of the invention are set forth in the following detailed description and accompanying drawings.

DRAWINGS

DETAILED DESCRIPTION

Figure 1:
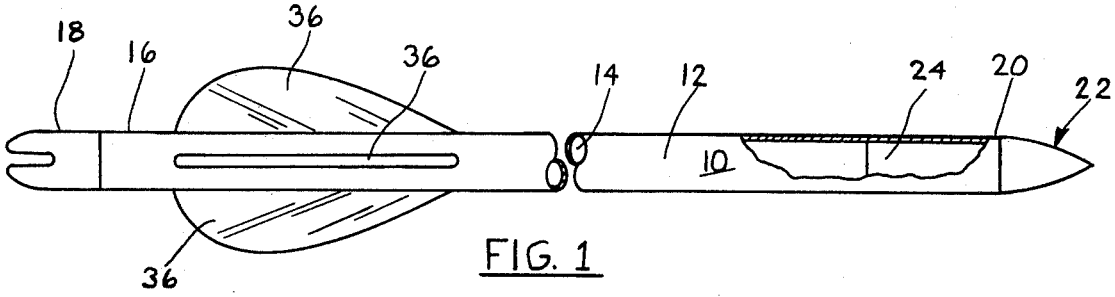
FIG. 1 is a schematic, fragmentary side elevation of a first preferred embodiment of the improved archery arrow of the invention showing the improved pile of the invention, portions being broken away to illustrate certain internal features.
Figure 2:
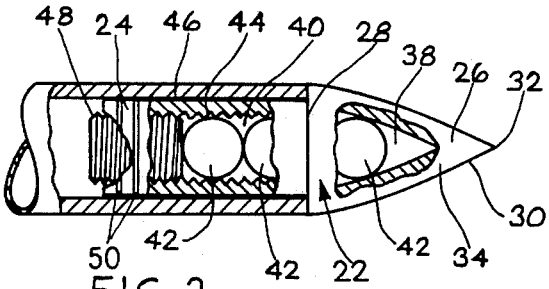
FIG. 2 is a schematic fragmentary enlarged side elevation of the pile portion of the arrow of FIG. 1, portions being broken away to illustrate certain features.

FIGS. 1 and 2:

Now referring more particularly to FIGS. 1 and 2 of the accompanying drawings, a first preferred embodiment of the improved arrow of the invention is shown. Thus, an arrow 10 utilizable in target archery and the like is shown. It comprises an elongated hollow shaft 12 having a central space 14 along the length thereof. To the rear end 16 of shaft 12 is secured a conventional string nock 18 and to the front end 20 of shaft 12 is secured an improved arrow pile 22. Pile 22 comprises (FIG. 2) an elongated hollow tube 24 slideably disposed within the front end 20 of shaft 12, as shown in FIGS. 1 and 2, and a point 26 secured to the front end of tube 24. As shown more particularly in FIG. 2, point 26 has a rear end 28 which is of the same external diameter as shaft 12 so that end 28 forms a smooth essentially continuous surface with the front end 20 of shaft 12. The front end 30 of point 26 terminates in a sharp narrow tip 32. The surface (external) 34 of point 26 which lies between tip 32 and rear end 28 is continuously and smoothly curved to form a generally dome-shaped configuration.

It will be noted that neither rear end 28 nor front end 30 nor any of surface 34 of point 26 has discontinuities, grooves or irregularities thereon. Instead, point 26 has smooth continuous surfaces which assure smooth release of point 26 from under a draw check (not shown) and also channeling in an improved manner of air along shaft 12 to vanes 36 (FIG. 1). Those vanes 36 may be relatively small and light in weight in contrast to vanes used with conventional arrows of the same diameter. There are shown three vanes 36 spaced around and connected to the periphery of shaft 12 adjacent nock 18, as with conventional arrows. Other numbers and configurations of vanes can be used, if desired. Moreover, shaft 12 can be of aluminum, steel, etc., and pile 22 of steel, aluminum, a combination of the two metals, etc. Nock 18 can be of plastic, metal, etc., all as conventional in the art.

The improved air flow to vanes 36, due to the configuration of point 26, permits the reduction in size and weight of vanes 36, in contrast to conventional arrows, which preserves arrow stability while substantially increasing arrow speed. Thus, so-called "p-15" type small vanes, normally used only with small diameter arrows, such as those known in the art as 1516's, 1616's and possibly 1716's, can now be used to stabilize larger diameter arrows such as 1818's, 1918's and even 2018's. The vanes used, due to the improved air flow provided by point 26, can cause an effective reduction in total vane size and surface area of up to one-half and more, thus substantially reducing the weight of the arrow, due to the change in vane weight. Such reduction can result in the arrow traveling sufficiently faster so that, for example, at 60 yds. the arrow of the invention may impact the target 9 inches higher than an otherwise identical arrow, except for the pile and the size of the vanes. Arrow speeds can be increased as much as 10% and more, all without sacrificing arrow stability and accuracy. The arrow of the invention can fly through the air in a flatter trajectory for a greater distance so that the effective area of the target face is substantially increased, thus facilitating higher tournament scores. All this is due to the channeling of air by point 26.

Point 26 may be made hollow, as shown in FIG. 2 or solid. Thus, point 26 has a central cavity 38 opening on and continuous with the hollow central cavity 40 of tube 24, either or both of which can be totally or partially filled with weights or the like, as desired, for balancing pile 22. It will be noted that cavities 38 and 40, as shown in FIG. 2, contain a plurality (in this case three) of readily movable weights, such as ball bearings 42. The internal surface 44 of wall 46 of tube 24 may be threaded to adjustably receive a threaded set screw 48 which holds bearings 46 in place. Alternatively, a simple removable tap plug (not shown) can be used in cavity 40 for such purposes. The number and positioning of weights 42 and screw 48 determine the weight and balance of pile 22. They can be adjusted to provide for ease of fine tuning and they cooperate with the improved shape of point 26 to provide improved arrow flight, all at little expense. Further weight adjustment can be made by breaking off one or more rear portions of tube 24 at scorelines 49.

Figure 3:
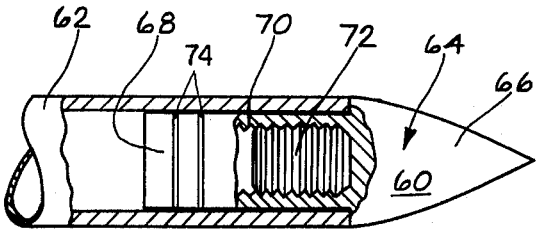
FIG. 3 is a schematic enlarged side elevation of a second preferred embodiment of the pile of the improved arrow of the present invention.

FIG. 3:

A second embodiment of the improved arrow of the invention is schematically and fragmentarily depicted in FIG. 3. Thus, an arrow 60 is shown which includes vanes (not shown), and shaft 62, with pile 64 inserted at the front end thereof. Pile 64 includes a point 66 shaped like point 26 and secured to a rearwardly extending hollow pile tube 38 having a threaded inner surface 70 receiving a threaded set screw 72 therein. Screw 72 is weighted and is adjustable in location to permit proper balancing of pile 64 and arrow 60 for improved flight. Adjustment in balancing can also be made by breaking off portions of pile tube 68 at scorelines 74.

Figure 4:
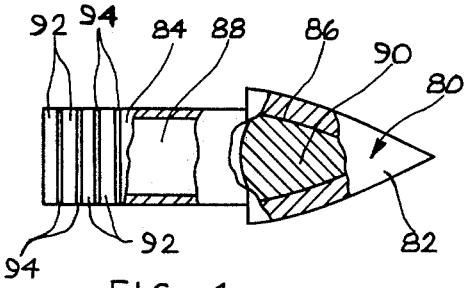
FIG. 4 is a schematic enlarged side elevation of a third preferred embodiment of the pile of the improved arrow of the present invention.

FIG. 4:

A third embodiment of the pile of the present invention is schematically depicted in FIG. 4. Thus, a pile 80 is shown which includes a point 82 connected at its rear end to a hollow tube 84 of narrower diameter than point 82. Point 82 has the same general external and internal configuration as points 26 and 66. Thus, it is hollow, having a cavity 86 continuous with cavity 88 of tube 84. Cavity 86 and/or cavity 88 contains a ballast material 90, such as poured solidified lead, which is easily removable, as by drilling, or by heating it and pouring it out of pile 80. Thus, the weight and weight distribution of pile 80 can be readily adjusted by ballast 90. The weight and weight distribution of pile 80 can also be adjusted by breaking off one or more rear portions 92 of tube 84, as by a pliers, at scorelines 94 in the outer surface thereof.

Figure 5:
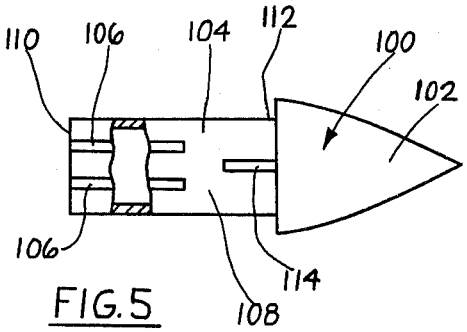
FIG. 5 is a schematic enlarged side elevation of a fourth preferred embodiment of the pile of the improved arrow of the present invention.

FIG. 5:

A further embodiment of the pile of the present invention is schematically depicted in FIG. 5. Thus, a pile 100 is shown which includes a point 102 connected at its rear end to a hollow tube 104 of narrow diameter. Point 102 has the external configuration of the previously described points of FIGS. 1–4 and may be hollow or solid. Moreover, tube 104 has a plurality of longitudinal slits 106 extending through the sidewall 108 thereof from the rear end 110 thereof for a portion of the length of tube 104 in order to permit tube 104 to be readily reduced in diameter during insertion into the shaft 12 of arrow 10 or the like so as to easily accommodate it to variations in the internal diameter of shaft 12 and facilitate its ease of insertion. Tube 104 is also slightly tapered down rearwardly to further facilitate such insertion. The front end 112 of tube 104 may be provided with one or more slits 114 to also facilitate such insertion.

Figure 6:
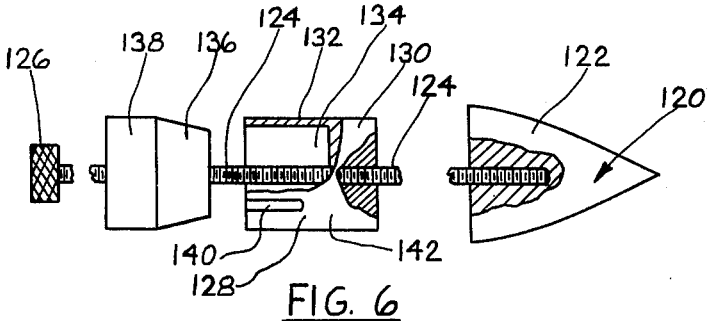
FIG. 6 is a schematic enlarged side elevation of a fifth preferred embodiment of the pile of the improved arrow of the present invention.

FIG. 6:

Another embodiment of the present improvements is depicted schematically in FIG. 6. Thus, a pile 120 is shown which includes a point 122 of the external configuration of the points of FIGS. 1–5. Point 122 threadably receives along the longitudinal axis thereof a rearwardly extending, elongated threaded screw 124, which terminates in a turn knob 126. Threadably received on screw 124 rearward of point 122 is a first tube member 128 having a generally solid front end 130 and a cup-shaped rearwardly opening rear end 132 defining a central cavity 134. Cavity 134 is adapted to receive the tapered front end 136 of a second tube member 138 threadably disposed on screw 124 rearward of member 128. End 136 increases in diameter rearwardly. Rear end 132 of member 128 has a longitudinal slit 140 extending through the thin sidewall 142 thereof so that end 136 can be expanded in external diameter by screwing tapered portion 136 forward into cavity 134. This can be carried out until that external diameter assures a proper fit between sidewall 142 and the sidewall of the front end 20 of shaft 12 or the like. Moreover, the position of members 128 and 138 can be readily adjusted on screw 124 relative to point 122 so that proper balancing of pile 120 can be accomplished.

It will be understood that various features of the embodiments can, if desired, be combined and that these and other features of the invention can be modified, changed and altered as desired to accomplish the intended purposes. All such changes, modifications and alterations as are within the scope of the appended claims form part of the present invention.

What is claimed is:

1. An improved archery arrow, said arrow comprising, in combination:
   a. a hollow elongated arrow shaft bearing arrow vanes adjacent its rear end; and,
   b. an arrow pile releasably secured to the front end of said arrow shaft, said pile comprising
      i. an aerodynamically forwardly tapered down, dome-shaped hard point,
      ii. a hollow pile tube connected to the rear end of said point and recessed inwardly thereof, said pile tube being releasably slideably disposed in said shaft front end so that the leading edge of said shaft front end abuts the rear edge of said point to form a smooth, essentially continuous surface therewith, said pile tube being scored transversely and thus being readily breakable for shortening and lightening said tube, and
      iii. control means for readily adjusting and positioning the weight of said pile to adjust the spine and balance of said arrow for fine tuning.

2. The improved archery arrow of claim 1 wherein at least one of said pile point and pile tube is at least partially filled with readily removable weight material.

3. The improved archery arrow of claim 2 wherein said weight material is disposed in said point, with access thereto from said pile tube.

4. The improved archery arrow of claim 2 wherein said weight material is disposed in said pile tube.

5. The improved archery arrow of claim 3 wherein said weight material comprises a weighted plug.

6. The improved archery arrow of claim 5 wherein said plug comprises a threaded set screw threadably adjustably received within said pile tube.

7. The improved archery arrow of claim 5 wherein said weight material includes at least one bearing held in place by said plug.

8. The improved archery arrow of claim 7 wherein said point is hollow and wherein said bearings extend thereinto.

* * * * *